US008690630B2

(12) United States Patent
Lau

(10) Patent No.: US 8,690,630 B2
(45) Date of Patent: Apr. 8, 2014

(54) BUBBLE GENERATING DEVICE AND METHOD FOR FORMING A BUBBLE FILM

(76) Inventor: Chun Yuen Lau, Hong Kong (HK)

( * ) Notice: Subject to any disclaimer, the term of this patent is extended or adjusted under 35 U.S.C. 154(b) by 113 days.

(21) Appl. No.: 13/558,376

(22) Filed: Jul. 26, 2012

(65) Prior Publication Data

US 2013/0125991 A1 May 23, 2013

Related U.S. Application Data

(60) Provisional application No. 61/560,812, filed on Nov. 17, 2011.

(51) Int. Cl.
*A63H 33/28* (2006.01)
*A63H 33/00* (2006.01)

(52) U.S. Cl.
USPC ..... 446/15; 446/473; 446/475

(58) Field of Classification Search
CPC ..... A63H 33/28; B65D 23/00; F41H 9/10; F41H 9/004
USPC ..... 472/15–21, 473, 475; 222/78, 79
See application file for complete search history.

(56) References Cited

U.S. PATENT DOCUMENTS

| | | | | |
|---|---|---|---|---|
| 5,613,890 | A * | 3/1997 | DeMars | 446/15 |
| 7,056,182 | B2 * | 6/2006 | Wan | 446/15 |
| 7,059,930 | B2 * | 6/2006 | Choi | 446/15 |
| 7,182,665 | B2 * | 2/2007 | Thai | 446/15 |
| 7,390,236 | B2 * | 6/2008 | Thai | 446/15 |

* cited by examiner

*Primary Examiner* — Kien Nguyen

(57) ABSTRACT

A bubble generating toy includes a bubble forming assembly mounted inside a housing behind a front opening thereof. The bubble forming assembly includes a cylindrical body having diametric inlet and outlet, a cylindrical air gate having diametric inlet and outlet. The air gate is rotatable in the cylindrical body between a closed position and open position when the inlets and outlets are aligned. A sleeve extends perpendicularly from the outlet of the cylindrical body and has a bubble ring. Bubble forming liquid is pumped from a container, through a tube and into the sleeve by a pump to form a bubble film across the bubble ring. An air blower blows are through the sleeve and the bubble ring to generate bubbles.

20 Claims, 8 Drawing Sheets

BUBBLE GENERATING DEVICE AND METHOD FOR FORMING A BUBBLE FILM

CROSS-REFERENCE TO RELATED APPLICATIONS

This application claims priority of U.S. Provisional Patent Application No. 61/560,812 filed on Nov. 17, 2011, the entire content of which is hereby incorporated by reference.

FIELD OF THE PATENT APPLICATION

The present patent application relates to a bubble generating device. The present patent application also relates to a method for forming a bubble film in a bubble generating device.

BACKGROUND

Bubble generating devices are known in the prior art. However, those bubble generating devices typically include a wiper bar or a mechanical device moveable over an opening to form a bubble film. When air is blown into the film-formed opening, bubbles are generated. However, the wiper bar or the mechanical devices detract from a good looking bubble generating product. The cool design of a bubble generating product can be undercut by such kind of construction located at the outer front side of the product.

There is a need to produce a bubble generating device and a method for forming a bubble film in a bubble generating device without a wiper bar or any external bubble forming mechanism.

The above description of the background is provided to aid in understanding a bubble generating device and a method for forming a bubble film, but is not admitted to describe or constitute pertinent prior art to the bubble generating device and the method for forming a bubble film disclosed in the present application, or consider any disclosures as material to the patentability of the claims of the present application.

SUMMARY

According to one aspect of the present application, there is provided a bubble generating device including a housing having a front opening and a cylindrical body mounted inside the housing inwardly behind the front opening thereof and defining an axis of rotation. The cylindrical body may have diametric inlet and outlet formed thereon with the outlet being facing the front opening. The bubble generating device may include an air gate in the form of a cylindrical pipe having diametric inlet and outlet formed thereon. The air gate can be snugly received in the cylindrical body and rotatable therein about the axis of rotation between a closed position where the inlet and outlet of the air gate are out of alignment with the inlet and outlet of the cylindrical body, and an open position where the inlet and outlet of the air gate are in alignment with the inlet and outlet of the cylindrical body to define a diametric air passage. The bubble generating device may further include a sleeve extending perpendicularly from the outlet of the cylindrical body and having a bubble ring mounted therein in alignment with the outlet of the cylindrical body. A pump driven by an electric motor can be used for pumping a liquid capable of forming bubbles into the sleeve through an aperture at an upper portion thereof, and an air blower driven by the motor can be used for blowing air through an air tunnel, the air passage and the bubble ring. Actuation of a trigger mechanism can move the air gate from the closed position to the open position, and activates the motor thereby pumping the liquid into the sleeve to continuously form a film of liquid across the bubble ring in the sleeve, and blowing air at the film of liquid to generate and discharge bubbles through the front opening of the housing.

According to one embodiment, the trigger mechanism may include a trigger and an integral vertical bar formed with a vertical slot. The vertical slot can be adapted to receive therein an eccentric pin extending outwardly from a rotatable plate fixed at one end of the air gate, whereby pulling the trigger moves the vertical bar backwards thereby dragging the eccentric pin backwards and downwards along the slot and turning the rotatable plate and the air gate 90° anticlockwise from the closed position to the open position. The trigger mechanism may move the air gate and activates the motor simultaneously.

According to one embodiment, the liquid is pumped from a container, through a tube and into the sleeve. The container may be mounted below the sleeve. The bubble generating device may further include a funnel mounted below the sleeve and above the container for draining excess liquid back into the container.

According to one embodiment, the bubble generating device may further include a plurality of light emitting diodes and a printed circuit board for controlling the light emitting diodes. The bubble generating device may further include a light emitting diode mounted inside a slot provided above the sleeve to simulate laser beam. The bubble generating device may further include a speaker.

According to one embodiment, the electric motor can be energized by one or more batteries, the pump can be a peristaltic pump, and the housing may be in the shape of a toy gun.

According to another aspect of the present application, there is provided a bubble forming assembly of a bubble generating device including a cylindrical body mounted inside a housing of the bubble generating device inwardly behind a front opening thereof and defining an axis of rotation. The cylindrical body may have diametric inlet and outlet formed thereon with the outlet being facing the front opening. The bubble forming assembly may include an air gate in the form of a cylindrical pipe having diametric inlet and outlet formed thereon. The air gate can be snugly received in the cylindrical body and rotatable therein about the axis of rotation between a closed position where the inlet and outlet of the air gate are out of alignment with the inlet and outlet of the cylindrical body, and an open position where the inlet and outlet of the air gate are in alignment with the inlet and outlet of the cylindrical body to define a diametric air passage. The bubble forming assembly may include a sleeve extending perpendicularly from the outlet of the cylindrical body and having a bubble ring mounted therein in alignment with the outlet of the cylindrical body.

According to one embodiment, the bubble forming assembly may further include a container mounted below the sleeve and containing a liquid capable of forming bubbles, and a pump driven by an electric motor for pumping the liquid from the container, through a tube, and into the sleeve through an aperture at an upper portion thereof. The bubble forming assembly may further include a funnel mounted below the sleeve and above the container for draining excess liquid back into the container. The bubble forming assembly may further include an air blower driven by the motor for blowing air through an air tunnel, the air passage and the bubble ring. The bubble forming assembly may further include a trigger mechanism having a trigger and an integral vertical bar formed with a vertical slot. The vertical slot can be adapted to receive therein an eccentric pin extending outwardly from a rotatable plate fixed at one end of the air gate, whereby pulling the trigger moves the vertical bar backwards thereby dragging the eccentric pin backwards and downwards along the slot and turning the rotatable plate and the air gate 90° anticlockwise from the closed position to the open position.

According to a further aspect of the present application, there is provided a method for forming a bubble film in a bubble generating device. The method includes the steps of (i) providing a cylindrical body having diametric inlet and outlet formed thereon and defining an axis of rotation, and mounting the cylindrical body inside a housing of the bubble generating device inwardly behind a front opening thereof; (ii) providing an air gate in the form of a cylindrical pipe having diametric inlet and outlet formed thereon, the air gate being snugly received in the cylindrical body and rotatable therein about the axis of rotation between a closed position where the inlet and outlet of the air gate are out of alignment with the inlet and outlet of the cylindrical body, and an open position where the inlet and outlet of the air gate are in alignment with the inlet and outlet of the cylindrical body to define a diametric air passage; (iii) providing a sleeve extending perpendicularly from the outlet of the cylindrical body and a bubble ring mounted therein in alignment with the outlet of the cylindrical body; and (iv) pumping a liquid capable of forming bubbles across the sleeve thereby continuously forming a bubble film across the bubble ring in the sleeve. The liquid may be pumped from a container, through a tube and into the sleeve by a pump.

Although the bubble generating device and the method for forming a bubble film disclosed in the present application are shown and described with respect to certain embodiments, it is obvious that equivalents and modifications will occur to others skilled in the art upon the reading and understanding of the specification. The present application includes all such equivalents and modifications, and is limited only by the scope of the claims.

BRIEF DESCRIPTION OF THE DRAWINGS

Specific embodiments of the bubble generating device and the method for forming a bubble film disclosed in the present application will now be described by way of example with reference to the accompanying drawings wherein.

DETAILED DESCRIPTION

Figure 1:
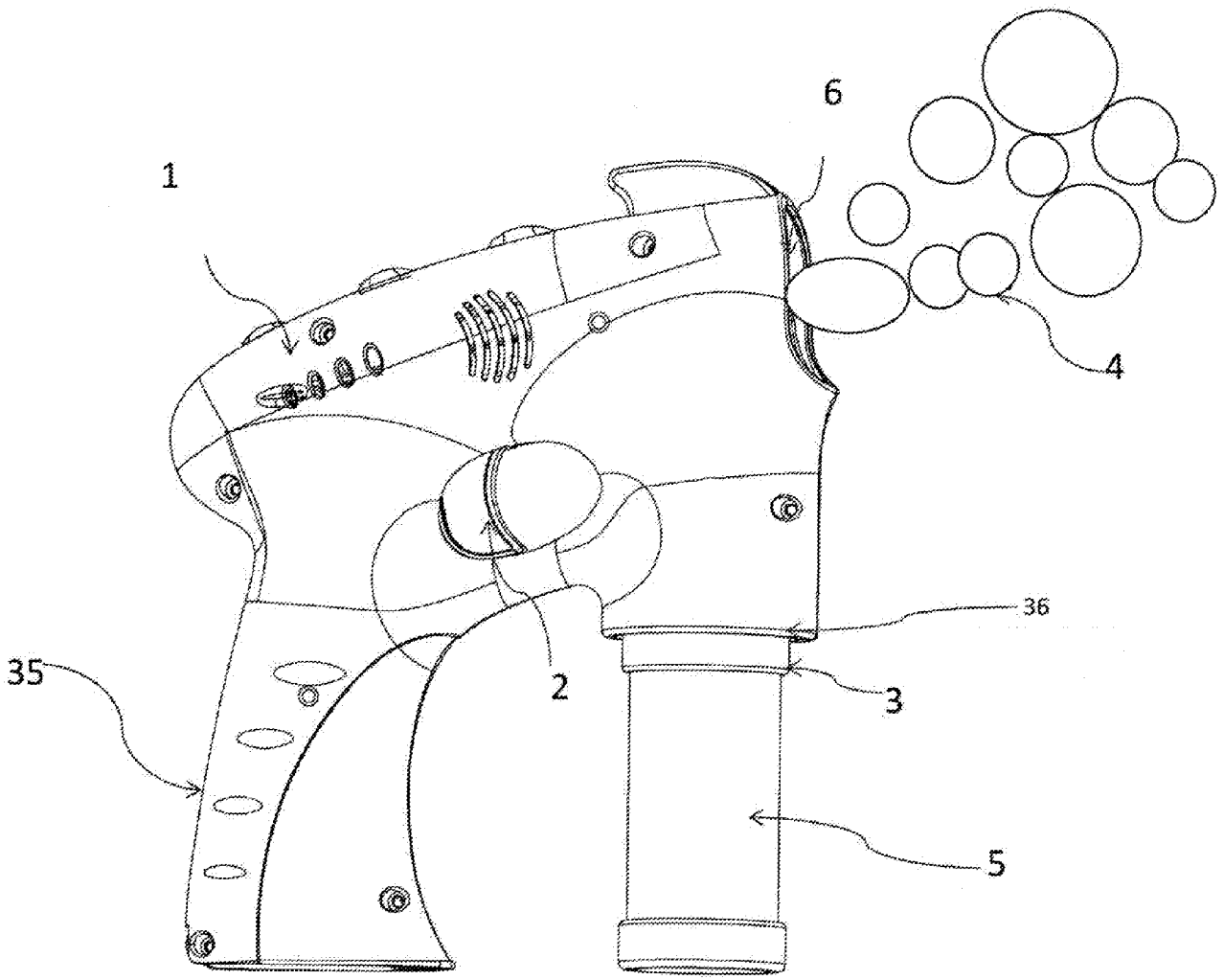
FIG. 1 is a perspective view of a bubble generating device according to an embodiment of the present application.
Figure 2:
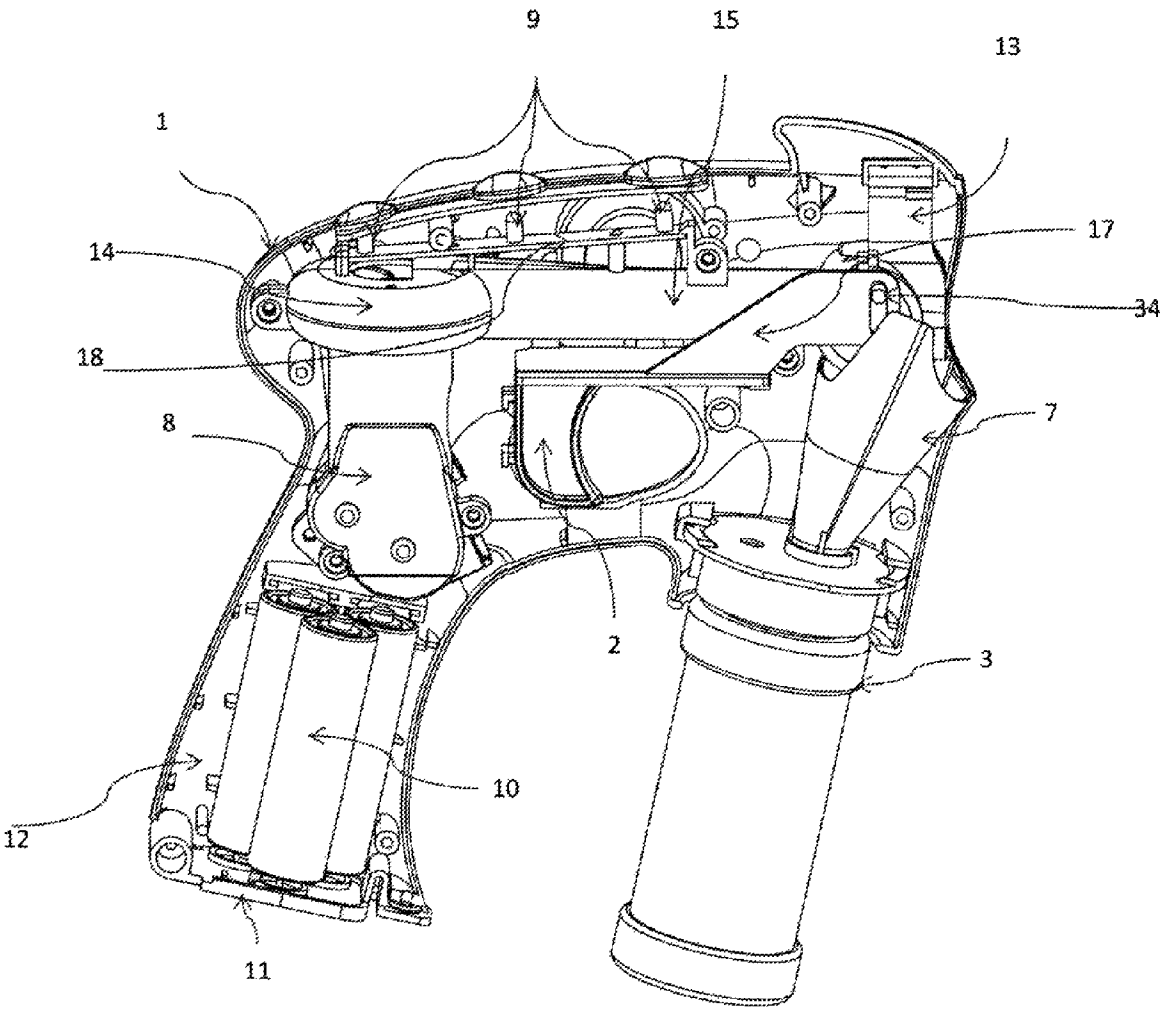
FIG. 2 is a perspective view of the bubble generating device with one side of the housing being removed.

Reference will now be made in detail to a preferred embodiment of the bubble generating device and the method for forming a bubble film disclosed in the present application, examples of which are also provided in the following description. Exemplary embodiments of the bubble generating device and the method for forming a bubble film disclosed in the present application are described in detail, although it will be apparent to those skilled in the relevant art that some features that are not particularly important to an understanding of the bubble generating device and the method for forming a bubble film may not be shown for the sake of clarity.

Furthermore, it should be understood that the bubble generating device and the method for forming a bubble film disclosed in the present application are not limited to the precise embodiments described below and that various changes and modifications thereof may be effected by one skilled in the art without departing from the spirit or scope of the appended claims. For example, elements and/or features of different illustrative embodiments may be combined with each other and/or substituted for each other within the scope of this disclosure and appended claims.

Certain terminology is used in the following description for convenience only and is not limiting. The words "front", "rear", "upper", "lower", "above" and "below" designate directions in the drawings to which reference is made. The terminology includes the words noted above as well as derivatives thereof and words of similar import.

It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element, or is in mechanical or electrical communication with another element.

FIG. 1 shows a bubble generating device according to an embodiment of the present application. According to the illustrated embodiment, the bubble generating device is a toy gun, though it can be any other toy and in any other shape. The bubble generating device may have an outer housing 1 having a front opening 6 provided at a front end of the bubble generating device. The housing 1 may be made of plastic or any other suitable material.

The bubble generating device may have a handle 35, a trigger 2, a front opening 6 and a detachable bottle or container 3. The container 3 may contain a liquid 5 capable of forming bubbles. The bubble forming liquid 5 can be a soapy liquid or any other possible liquid 5 capable of forming bubbles 4. The container 3 may be attached to an opening 36 provided at a front bottom side of the bubble generating device by complementary threads, snap fastening or any other conventional means. The container 3 may be disposed at a distance in front of the handle 35. The container 3 may be cylindrical in shape or may be in any other shapes. A player can hold the bubble generating device by gripping the handle 35 by one hand. The player can also hold the bubble generating device by gripping the handle 35 by one hand and gripping the container 3 by the other hand. The trigger 2 may serve as an on/off switch of the bubble generating device. When the player pulls the trigger 2, the bubble generating device can be activated and bubbles 4 can be generated and discharged from the front opening 6 of the housing 1. When the trigger 2 is released, the generation of bubbles will be terminated.

As depicted in FIGS. 2-6, the bubble generating device may include a bubble forming assembly which may be mounted entirely inside the housing 1 inwardly behind the front opening 6 of the housing 1. As a result of this arrangement, the bubble forming assembly can be hidden inside the housing 1 and cannot be visible from the outside of the bubble generating device.

Figures 7, 8:
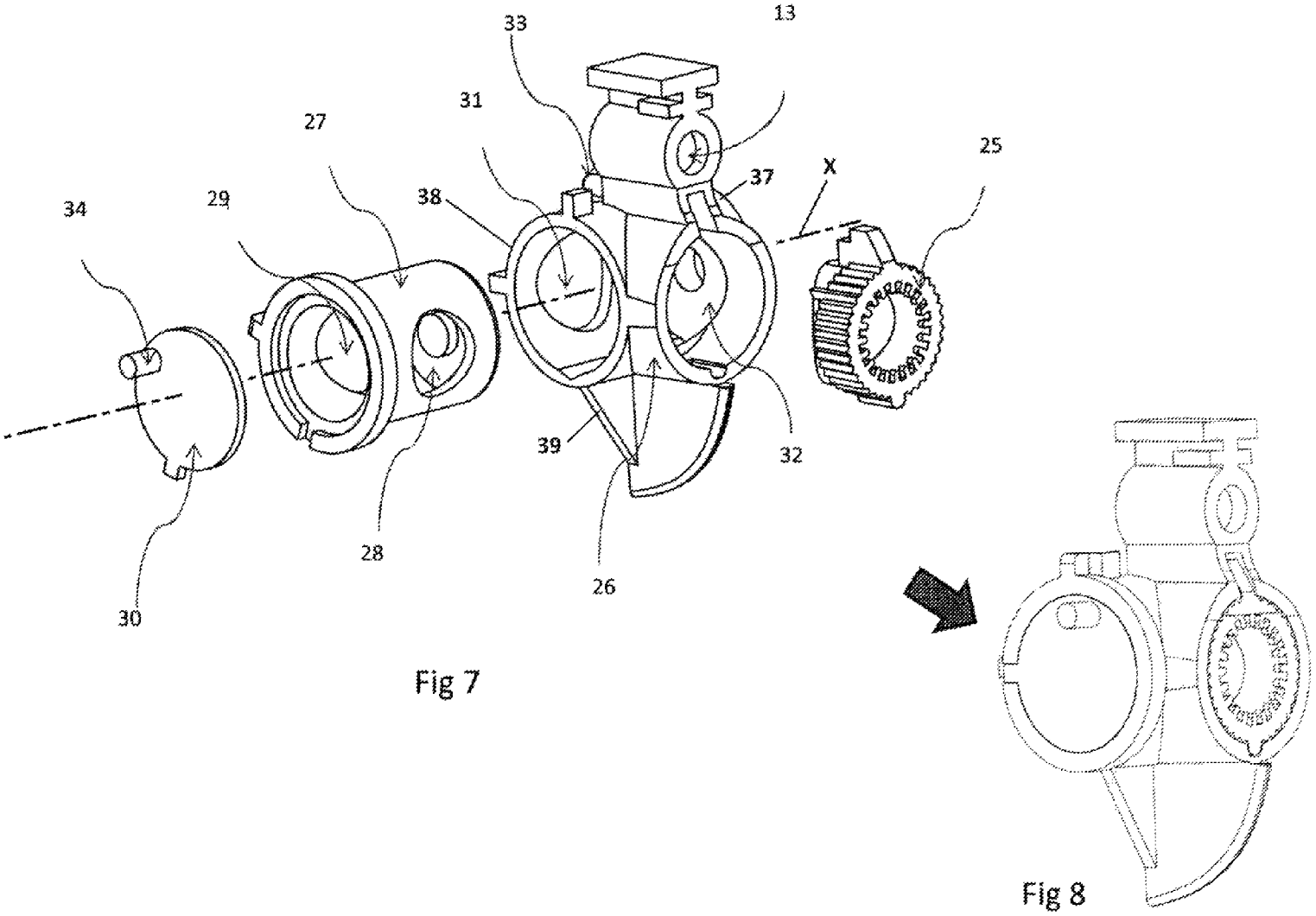
FIG. 7 is an enlarged exploded view of the film forming assembly of the bubble generating device according to an embodiment of the present application.
FIG. 8 shows an assembled film forming assembly of the bubble generating device.

According to the embodiment best illustrated in FIGS. 7 and 8, the bubble forming assembly may include a cylindrical body 38 mounted inside the housing 1 inwardly behind the front opening 6 of the housing 1. The cylindrical body 38 defines an axis of rotation X. The cylindrical body 38 may include diametric inlet 31 and outlet 32 formed thereon. The outlet 32 of the cylindrical body 38 can be facing the front opening 6 of the housing 1.

Figure 10:
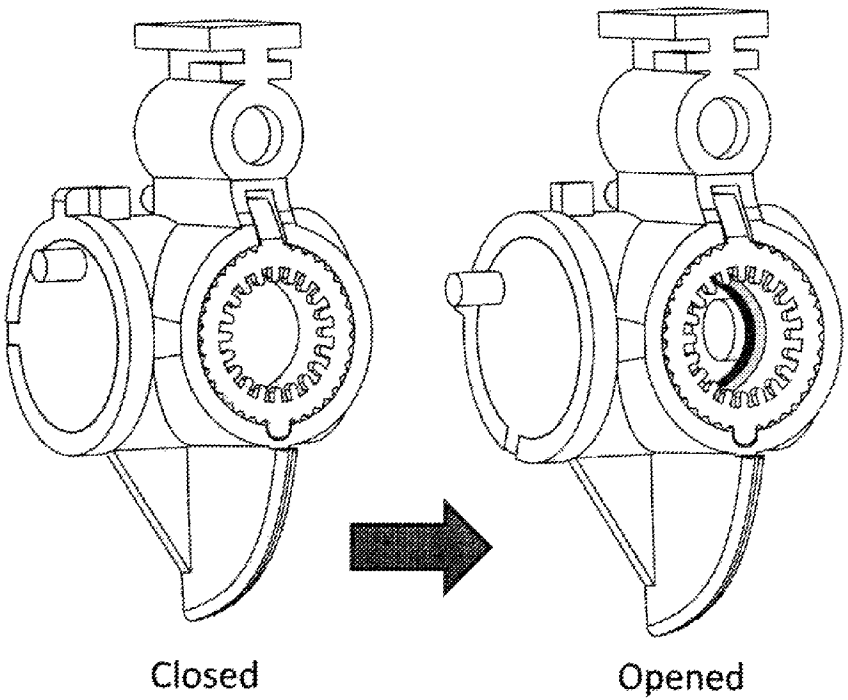
FIG. 10 is a perspective view of the film forming assembly of the bubble generating device in a closed position and an open position.
Figure 9:
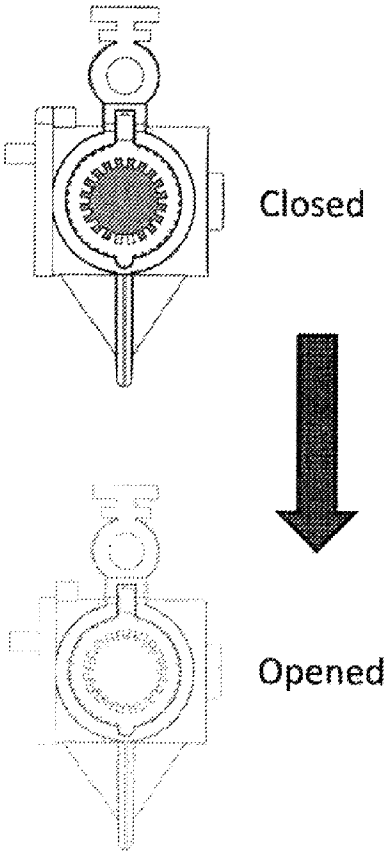
FIG. 9 is a front view of the film forming assembly of the bubble generating device in a closed position and an open position.

The bubble forming assembly may also include an air gate 27 in the form of a cylindrical pipe having diametric inlet 29 and outlet 28 formed thereon. The air gate 27 can be snugly received in the cylindrical body 38 and rotatable therein about the axis of rotation X. As indicated in FIGS. 9 and 10, the air gate 27 can rotate in the cylindrical body 38 between a closed position where the inlet 29 and outlet 28 of the air gate 27 are out of alignment with the inlet 31 and outlet 32 of the cylindrical body 38, and an open position where the inlet 29 and outlet 28 of the air gate 27 are in alignment with the inlet 31 and outlet 32 of the cylindrical body 38 to define a diametric air passage extending across the cylindrical body 38 and the air gate 27.

The bubble forming assembly may further include a sleeve 26 extending perpendicularly from the outlet 32 of the cylindrical body 38. A bubble ring 25 may be mounted within the sleeve 26 in alignment with the outlet 32 of the cylindrical body 38.

Figure 3:
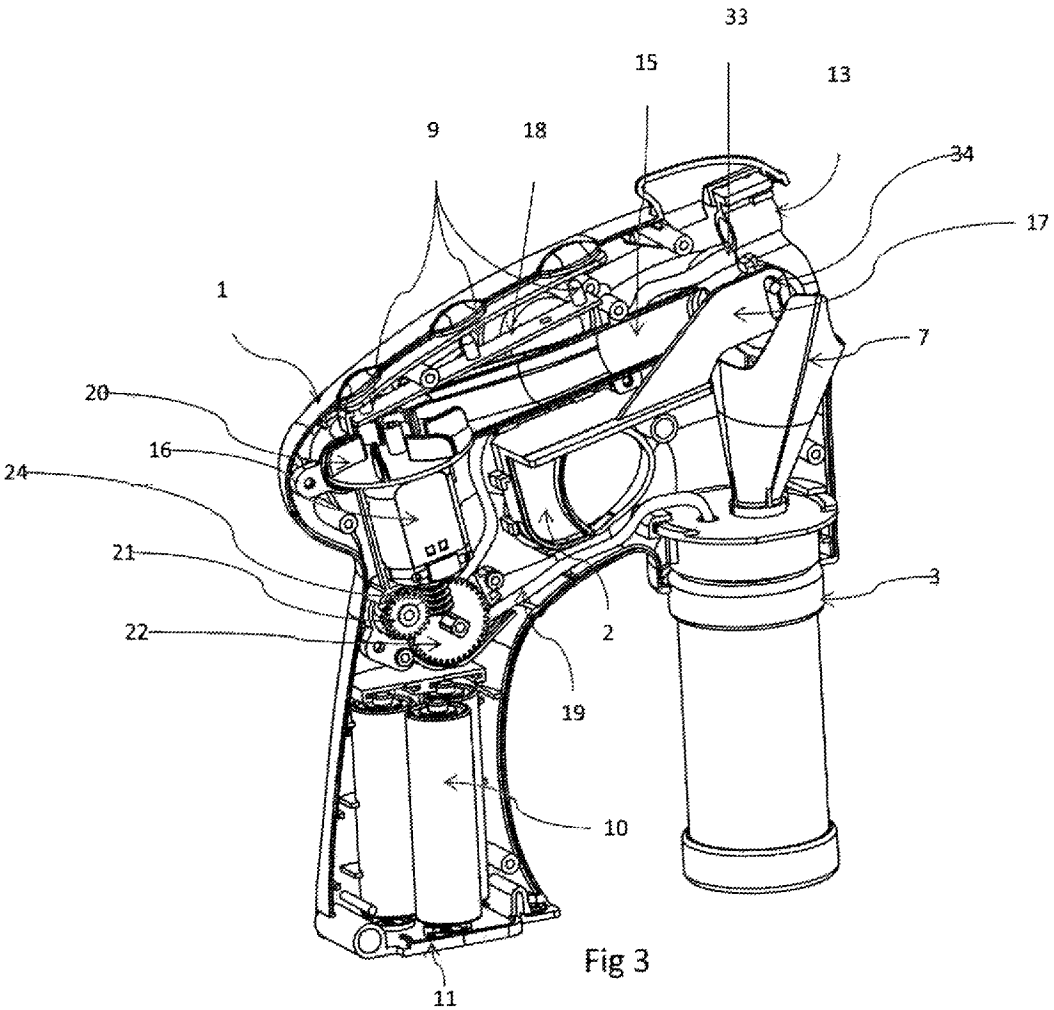
FIG. 3 is a perspective view of the bubble generating device with the fan, the motor and the gears being revealed.
Figure 4:
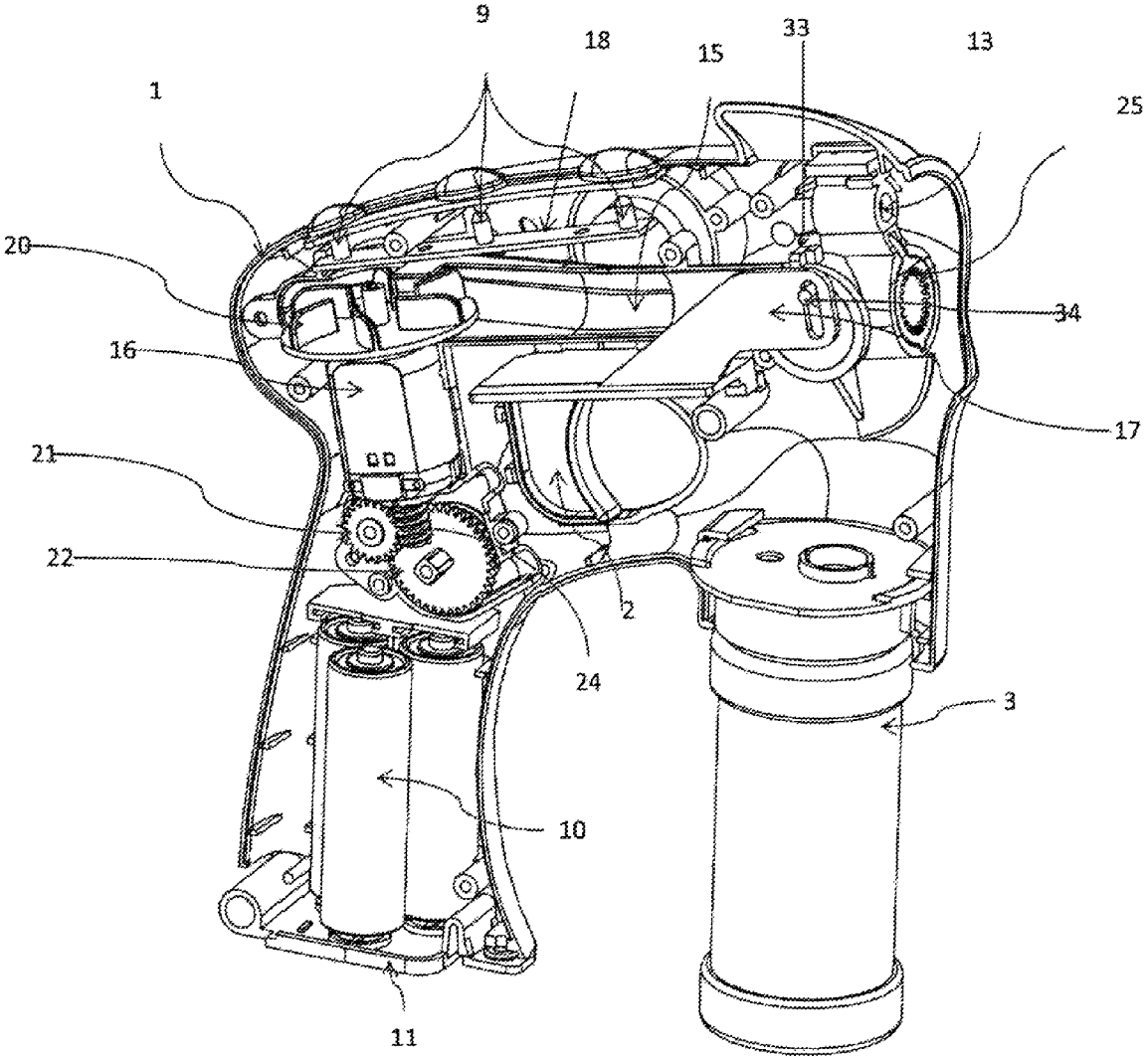
FIG. 4 is a perspective view of the bubble generating device with the funnel and the flexible tube being detached.
Figure 5:
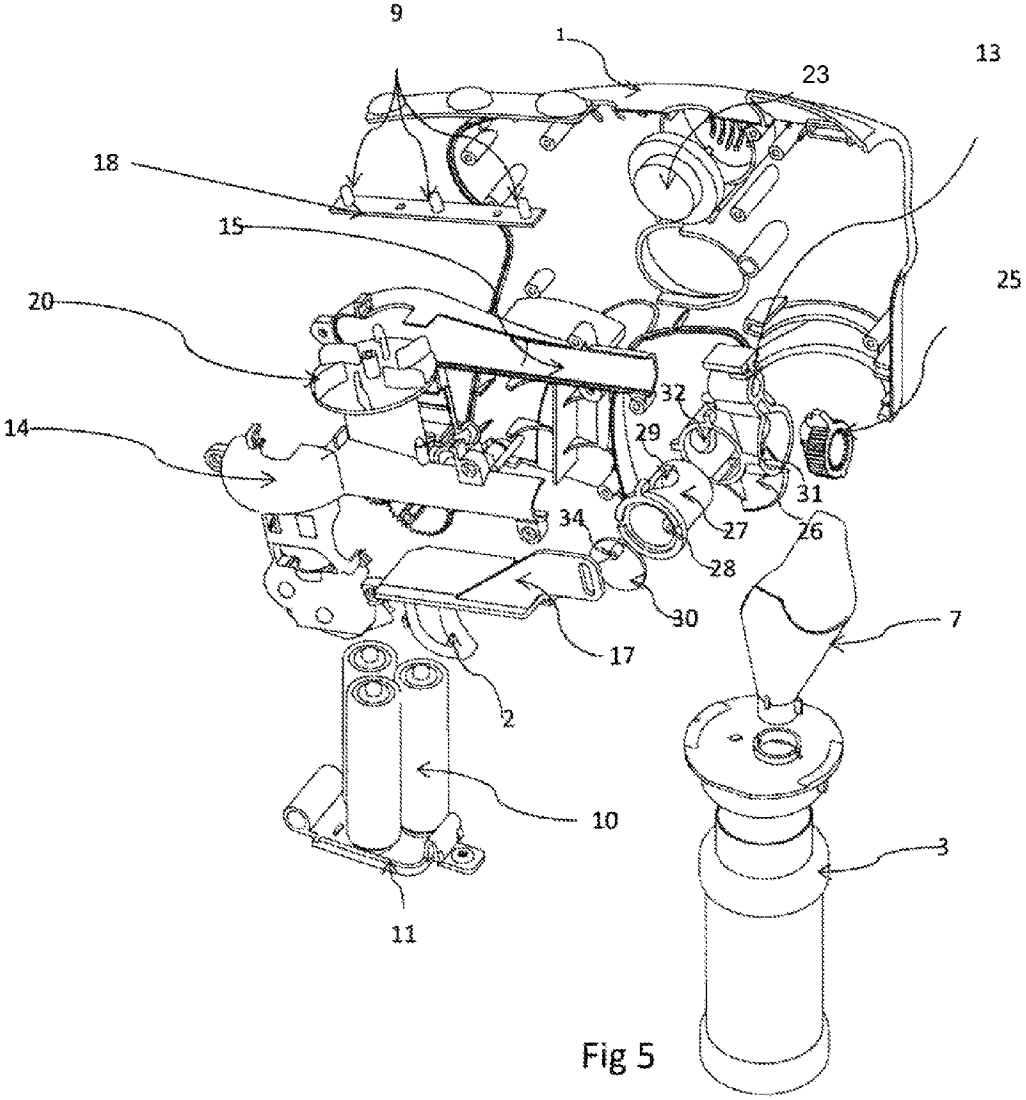
FIG. 5 is an exploded view showing various parts of the bubble generating device according to an embodiment of the present application.
Figure 6:
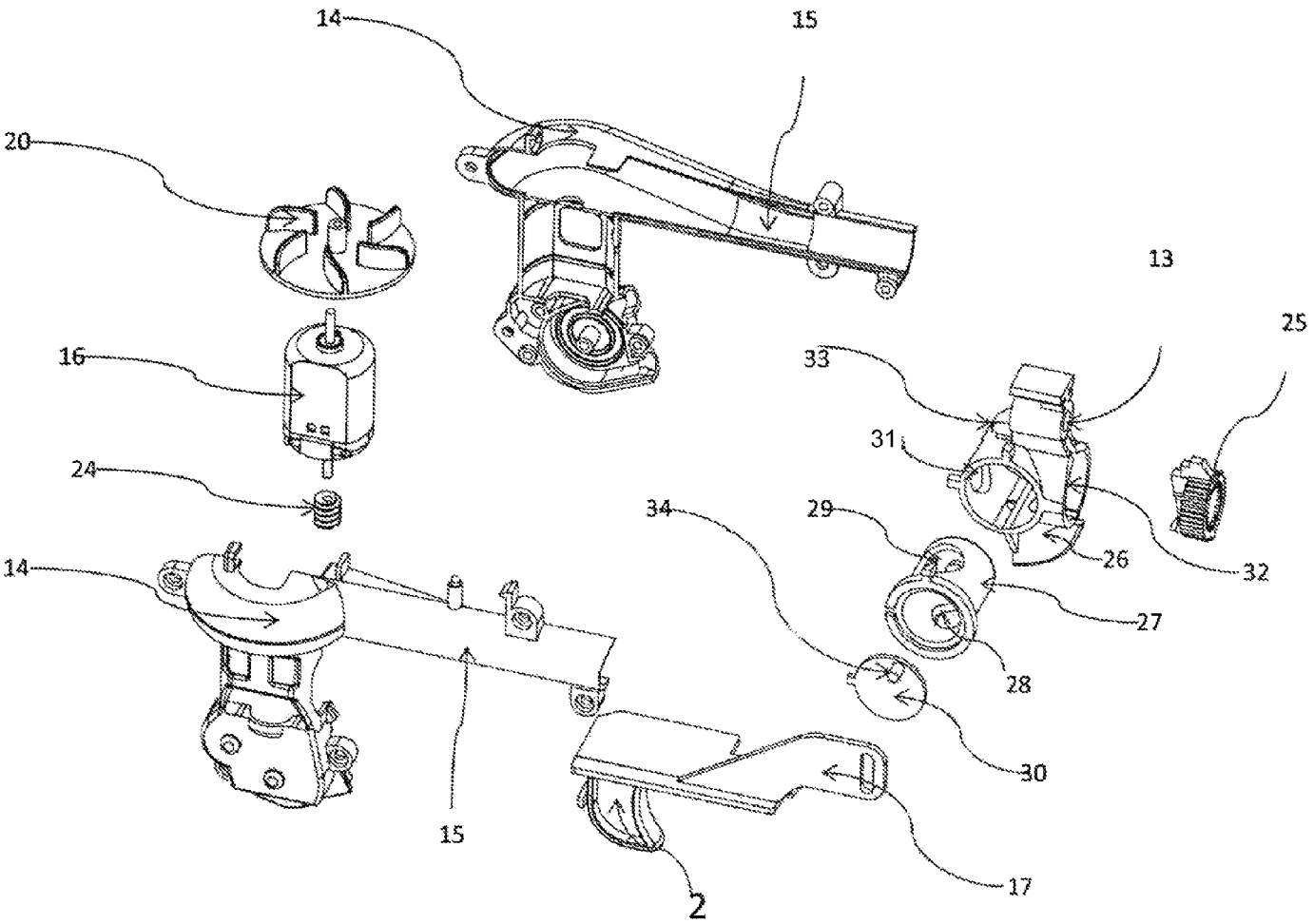
FIG. 6 is an enlarged exploded view showing various parts of the bubble generating device.

The bubble generating device may be provided with a built-in pump 8. The pump 8 may be located at a rear portion of the bubble generating device. The pump 8 may be driven by an electric motor 16 for pumping the bubble forming liquid 5 from the container 3, through a tube 19, and into the sleeve 26 through an aperture formed at an upper portion of the sleeve 26. According to the illustrated embodiment, the pump 8 can be a peristaltic pump with three gears, namely, a motor gear 24, a first gear 21, a second gear 22 and two rollers (not shown). Although it has been illustrated that the pump 8 is a peristaltic pump, it is understood by one skilled in the art that other suitable pump 8 such as a check valve pump or a gear pump can be used. The tube 19 may be made of plastic and flexible. One end of the tube 19 can be dipped into the bubble forming liquid 5 inside the container 3 through a top opening thereof, as depicted in FIG. 3. The tube 19 may extend to the pump 8 and then to a junction 33 and a chamber 37 formed integrally at an upper portion of the sleeve 26. The bubble forming liquid 5 discharging from the downstream end of the tube 19 can flow into the chamber 37 through an aperture at the junction 33, and then flow from the chamber 37 into the sleeve 26.

A built-in air blower 14 may be driven by the motor 16 for blowing air through the air passage. The air blower 14 may include an air fan 20 and an air tunnel 15. When the air blower 14 is activated by the motor 16, the fan 20 rotates and drives air through the air tunnel 15, the air passage and then the bubble ring 25. The pump 8 and the air blower 14 can be activated at the same time. The motor 16, the pump 8 and the fan 20 may be covered by a single inner housing to form a single unit inside the outer housing 1 of the bubble generating device.

A power source can be employed to supply electricity to the motor 16 to energize the pump 8 and the air blower 14. The power source can be one or more "AA" size batteries 10 accommodated within a battery compartment defined by the handle 35. A battery compartment door 11 of the battery compartment can be disposed at a lowermost end of the handle 35 for easy installation and access of the batteries 10. This battery-operated bubble generating device can provide a convenient hand-held bubble generating device for outdoor use.

A funnel 7 may be mounted below the sleeve 26 and above the container 3 for draining excess bubble forming liquid 5 back into the container 3, as best illustrated in FIG. 7. A plurality of tapering drip pieces 39 may be provided at the lower ends of the cylindrical body 38 and the sleeve 26 for guiding the draining of the excess bubble forming liquid 5 from the lower ends of the cylindrical body 38 and the sleeve 26 towards the funnel 7. The lower end of the funnel 7 can be connected to an opening formed on a top wall of the container 3.

The bubble generating device may include a trigger mechanism. The trigger mechanism can be coupled with the air gate 27 of the bubble forming assembly and the motor 16. The trigger mechanism may include a trigger 2 located near the handle 35. A metal spring (not shown) may be fixed at a rear end of the trigger 2. When the trigger 2 is pulled, the metal spring can be in contact with a metal shell of the motor 16 in order to close a circuit, thereby energizing the motor 16 and activating the pump 8 and the air blower 14. When the trigger 2 is released, the metal spring can become out of contact with the metal shell of the motor 16, and the bubble generating device can be switched off.

According to the illustrated embodiment, the trigger 2 may include an integral vertical bar 17 with a vertical slot formed thereon. The vertical slot can be adapted to receive therein an eccentric pin 34 extending outwardly from a circular plate 30 fixed at one end of the air gate 27, whereby pulling the trigger 2 moves the vertical bar 17 backwards thereby dragging the eccentric pin 34 backwards and downwards along the slot and turning the circular plate 30 and the air gate 27 anticlockwise 90° from the closed position to the open position. The pulling of the trigger 2 backwards can translate linear motion of the trigger 2 to rotational motion of the air gate 27. It is understood by one skilled in the art that other possible trigger mechanism can be employed to rotate the air gate 27. For example, the trigger may be provided with a rack meshed with a central pinion fixed at the air gate 27 to achieve the translation of linear motion of the trigger 2 to rotational motion of the air gate 27.

When a player pulls the trigger 2 of the bubble generating device, it moves the air gate 27 from the closed position to the open position. The pulling of the trigger 2 can also energize the motor 16 at the same time. When the motor 16 is energized, it can activate the pump 8 to pump bubble forming liquid 5 from the container 3 into the sleeve 26 to continuously form a film of bubble forming liquid across the bubble ring 25 inside the sleeve 26. Excess bubble forming liquid 5 may run downwardly from the sleeve 26 and into the funnel 7. The excess bubble forming liquid 5 can then flow back to the container 3 through the funnel 7. At the same time, the same motor 16 may also drive the fan 20 in the air blower 14 to spin and generate winds blowing through the air tunnel 15, the air passage and the bubble ring 25, thereby generating bubbles 4 which can be expelled through the front opening 6 of the housing 1.

The bubble generating device may further include a plurality of light emitting diodes (LEDs) 9 and a printed circuit board 18 for controlling the LEDs 9. The printed circuit board 18 can be used to control the lighting sequence of the LEDs 9.

It can also set the LEDs 9 at an illuminating/flashing mode so that the LEDs 9 can illuminate continuously or can flash. According to the illustrated embodiment, there are three LEDs 9 located above the air blower 14. The LEDs 9 can also be powered by the batteries 10. The bubble generating device may also be provided with a LED slot 13 above the sleeve 26. If a LED is installed in this LED slot 13, a light beam can be produced to simulate a laser effect, and can also illuminate the bubbles 4 being discharged from the front opening 6 of the bubble generating device.

The bubble generating device may further include a speaker 23 to produce predetermined sound effects when the bubble generating device is activated.

The bubble generating device disclosed in the present application is simple in construction and can be manufactured at a lower cost. The entire bubble forming assembly is mounted inside the housing 1 so that the bubble generating device can have a contemporary design. Since the bubble forming assembly is located inside the housing 1, it can be protected by the housing 1 and can less likely to be damaged. This can prolong the life of the product. The housing 1 can be made of solid plastic, or transparent or semi-transparent plastic. When transparent or semi-transparent housing 1 is used, the built-in LEDs 9 can illuminate through the transparent or semi-transparent housing 1 to create a phenomenal lighting effect when the bubble generating device is activated.

A method for forming a bubble film in a bubble generating device is also disclosed in the present application. The method may include the steps of (i) providing a cylindrical body 38 having diametric inlet 31 and outlet 32 formed thereon and defining an axis of rotation X, and mounting the cylindrical body 38 inside a housing 1 of the bubble generating device inwardly behind a front opening 6 thereof; (ii) providing an air gate 27 in the form of a cylindrical pipe having diametric inlet 29 and outlet 28 formed thereon, the air gate 27 being snugly received in the cylindrical body 38 and rotatable therein about the axis of rotation X between a closed position where the inlet 29 and outlet 28 of the air gate 27 are out of alignment with the inlet 31 and outlet 32 of the cylindrical body 38, and an open position where the inlet 29 and outlet 28 of the air gate 27 are in alignment with the inlet 31 and outlet 32 of the cylindrical body 38 to define a diametric air passage; (iii) providing a sleeve 26 extending perpendicularly from the outlet 32 of the cylindrical body 38 and a bubble ring 25 mounted therein in alignment with the outlet 32 of the cylindrical body 38; and (iv) pumping a liquid 5 capable of forming bubbles from a container 3, through a tube 19 and into the sleeve 26 by a pump 8 thereby continuously forming a bubble film across the bubble ring 25 in the sleeve 26. The air blower 14 can blow air through the bubble ring 25 in the sleeve 26 to generate bubbles 4.

While the bubble generating device and the method for forming a bubble-film disclosed in the present application have been shown and described with particular references to a number of preferred embodiments thereof, it should be noted that various other changes or modifications may be made without departing from the scope of the appending claims.

What is claimed is:

1. A bubble generating device comprising:

(a) a housing having a front opening;

(b) a cylindrical body mounted inside the housing inwardly behind the front opening thereof and defining an axis of rotation, the cylindrical body having diametric inlet and outlet formed thereon with the outlet being facing the front opening;

(c) an air gate in the form of a cylindrical pipe having diametric inlet and outlet formed thereon, the air gate being snugly received in the cylindrical body and rotatable therein about the axis of rotation between a closed position where the inlet and outlet of the air gate are out of alignment with the inlet and outlet of the cylindrical body, and an open position where the inlet and outlet of the air gate are in alignment with the inlet and outlet of the cylindrical body to define a diametric air passage;

(d) a sleeve extending perpendicularly from the outlet of the cylindrical body and having a bubble ring mounted therein in alignment with the outlet of the cylindrical body;

(e) a pump driven by an electric motor for pumping a liquid capable of forming bubbles into the sleeve through an aperture at an upper portion thereof; and (f) an air blower driven by the motor for blowing air through an air tunnel, the air passage and the bubble ring;

(g) whereby actuation of a trigger mechanism moves the air gate from the closed position to the open position, and activates the motor thereby pumping the liquid into the sleeve to continuously form a film of liquid across the bubble ring in the sleeve, and blowing air at the film of liquid to generate and discharge bubbles through the front opening of the housing.

2. The bubble generating device as claimed in claim 1, wherein the trigger mechanism comprising a trigger and an integral vertical bar formed with a vertical slot, the vertical slot being adapted to receive therein an eccentric pin extending outwardly from a rotatable plate fixed at one end of the air gate, whereby pulling the trigger moves the vertical bar backwards thereby dragging the eccentric pin backwards and downwards along the slot and turning the rotatable plate and the air gate 90° anticlockwise from the closed position to the open position.

3. The bubble generating device as claimed in claim 1, wherein the trigger mechanism moves the air gate and activates the motor simultaneously.

4. The bubble generating device as claimed in claim 1, wherein the liquid is pumped from a container, through a tube and into the sleeve.

5. The bubble generating device as claimed in claim 4, wherein the container is mounted below the sleeve.

6. The bubble generating device as claimed in claim 5, further comprising a funnel mounted below the sleeve and above the container for draining excess liquid back into the container.

7. The bubble generating device as claimed in claim 1, wherein the electric motor is energized by one or more batteries.

8. The bubble generating device as claimed in claim 1, further comprising a plurality of light emitting diodes.

9. The bubble generating device as claimed in claim 8, further comprising a printed circuit board for controlling the light emitting diodes.

10. The bubble generating device as claimed in claim 1, further comprising a light emitting diode mounted inside a slot provided above the sleeve to simulate laser beam.

11. The bubble generating device as claimed in claim 1, further comprising a speaker.

12. The bubble generating device as claimed in claim 1, wherein the pump is a peristaltic pump.

13. The bubble generating device as claimed in claim 1, wherein the housing is in the shape of a toy gun.

14. A bubble forming assembly of a bubble generating device comprising:

(a) a cylindrical body mounted inside a housing of the bubble generating device inwardly behind a front opening thereof and defining an axis of rotation, the cylindrical body having diametric inlet and outlet formed thereon with the outlet being facing the front opening;

(b) an air gate in the form of a cylindrical pipe having diametric inlet and outlet formed thereon, the air gate being snugly received in the cylindrical body and rotatable therein about the axis of rotation between a closed position where the inlet and outlet of the air gate are out of alignment with the inlet and outlet of the cylindrical body, and an open position where the inlet and outlet of the air gate are in alignment with the inlet and outlet of the cylindrical body to define a diametric air passage; and (c) a sleeve extending perpendicularly from the outlet of the cylindrical body and having a bubble ring mounted therein in alignment with the outlet of the cylindrical body.

15. The bubble forming assembly as claimed in claim 14, further comprising a container mounted below the sleeve and containing a liquid capable of forming bubbles, and a pump driven by an electric motor for pumping the liquid from the container, through a tube, and into the sleeve through an aperture at an upper portion thereof.

16. The bubble forming assembly as claimed in claim 15, further comprising a funnel mounted below the sleeve and above the container for draining excess liquid back into the container.

17. The bubble forming assembly as claimed in claim 15, further comprising an air blower driven by the motor for blowing air through an air tunnel, the air passage and the bubble ring.

18. The bubble forming assembly as claimed in claim 14, further comprising a trigger mechanism having a trigger and an integral vertical bar formed with a vertical slot, the vertical slot being adapted to receive therein an eccentric pin extending outwardly from a rotatable plate fixed at one end of the air gate, whereby pulling the trigger moves the vertical bar backwards thereby dragging the eccentric pin backwards and downwards along the slot and turning the rotatable plate and the air gate 90° anticlockwise from the closed position to the open position.

19. A method for forming a bubble film in a bubble generating device, the method comprising the steps of:

(a) providing a cylindrical body having diametric inlet and outlet formed thereon and defining an axis of rotation, and mounting the cylindrical body inside a housing of the bubble generating device inwardly behind a front opening thereof;

(b) providing an air gate in the form of a cylindrical pipe having diametric inlet and outlet formed thereon, the air gate being snugly received in the cylindrical body and rotatable therein about the axis of rotation between a closed position where the inlet and outlet of the air gate are out of alignment with the inlet and outlet of the cylindrical body, and an open position where the inlet and outlet of the air gate are in alignment with the inlet and outlet of the cylindrical body to define a diametric air passage;

(c) providing a sleeve extending perpendicularly from the outlet of the cylindrical body and a bubble ring mounted therein in alignment with the outlet of the cylindrical body; and (d) pumping a liquid capable of forming bubbles across the sleeve thereby continuously forming a bubble film across the bubble ring in the sleeve.

20. The method as claimed in claim 19, wherein the liquid is pumped from a container, through a tube and into the sleeve by a pump.

* * * * *